US008876695B2

(12) United States Patent
Wilson et al.

(10) Patent No.: US 8,876,695 B2
(45) Date of Patent: Nov. 4, 2014

(54) FOOT SLEEVE DILDO HARNESS

(76) Inventors: Joseph Wilson, Bogota, NJ (US); Andrew R Conner, Canton, MI (US)

( * ) Notice: Subject to any disclaimer, the term of this patent is extended or adjusted under 35 U.S.C. 154(b) by 439 days.

(21) Appl. No.: 12/896,696

(22) Filed: Oct. 1, 2010

(65) Prior Publication Data

US 2011/0082333 A1 Apr. 7, 2011

Related U.S. Application Data

(60) Provisional application No. 61/248,191, filed on Oct. 2, 2009.

(51) Int. Cl.
*A61H 19/00* (2006.01)

(52) U.S. Cl.
CPC ..... *A61H 19/44* (2013.01); *A61H 2201/1642* (2013.01); *A61H 2205/082* (2013.01); *A61H 2201/165* (2013.01); *A61H 2205/12* (2013.01)
USPC ..... 600/38

(58) Field of Classification Search
USPC ..... 600/38; 482/79; 602/27
See application file for complete search history.

(56) References Cited

U.S. PATENT DOCUMENTS

| | | | | |
|---|---|---|---|---|
| 4,989,592 | A | 2/1991 | Chang | |
| 5,103,810 | A | 4/1992 | Chang | |
| 6,540,667 | B2 | 4/2003 | Hickman | |
| 6,547,717 | B1 | 4/2003 | Green et al. | |
| 6,849,041 | B2 | 2/2005 | Astin | |
| 6,899,671 | B1 | 5/2005 | Fontenot | |
| 8,398,539 | B2 * | 3/2013 | Stevens | 600/38 |
| 2005/0043150 | A1 * | 2/2005 | Nitta et al. | 482/79 |
| 2009/0131744 | A1 | 5/2009 | Pattenden | |
| 2009/0229617 | A1 | 9/2009 | Bowman | |

* cited by examiner

*Primary Examiner* — Christine Matthews
(74) *Attorney, Agent, or Firm* — Michael J. Feigin, Esq.; Feigin & Associates, LLC

(57) ABSTRACT

A foot-sleeve dildo harness uses any of a variety of dildo devices secured in position on a bottom or heel of the foot and extending perpendicularly therefrom. The dildos provide vaginal or anal hands-free stimulation performed on a wearer or on a sexual partner.

9 Claims, 3 Drawing Sheets

FOOT SLEEVE DILDO HARNESS

CROSS-REFERENCE TO RELATED APPLICATIONS

The present utility patent application claims the advantage of provisional application No. 61/248,191 filed Oct. 2, 2009.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to sexual aids and particularly to a dildo sleeve harness which is attached to and worn on the foot of the user to allow for attachment of any strap-on compatible dildo to the bottom of the foot or to the back of the heel, the foot-worn dildo device comprising an elasticized foot-worn sleeve and an attached dildo harness through openings in which the dildo may be held or upon which the base of the dildo may rest and a strap and O-ring assembly used for holding the dildo in place against the dildo harness; the strap and O-ring assembly comprising an O-ring for surrounding the shaft of the dildo and straps attached to the dildo harness at the bottom of the foot and alternately the back of the heel together with straps that attach adjustably around the foot to hold the O-ring in place.

2. Description of Related Art Including Information Disclosed Under 37 CFR 1.97 and 1.98

Sexual satisfaction is an important aspect of a normal natural healthy life. While there are many hand-held devices for sexual self-satisfaction and body mounted devices for mutual sexual satisfaction, there is a lack of foot-mounted sexual satisfaction devices to permit hands-free sexual self-satisfaction and mutual satisfaction.

U.S. Pat. No. 6,899,671, issued May 31, 2005 to Fontenot, describes an intravaginal stimulation apparatus comprising a "Y" shaped tubular device with each of the three arms of the apparatus containing a flexible member. The apparatus is both extendable in width and length with each arm rotatably adjustable and affixed at two ends with adjustable cuffs for securing the apparatus to the user at the ankles. One end of the extendable arm is capable of quick adaptation to a variety of intravaginal appliances. In use, the apparatus is attached to the user's ankles via the adjustable cuffs, and is adjusted to the most comfortable position in a sitting or prone position. The user may then attach the intravaginal appliance of choice. Once insertion of the appliance is made, the user manipulates the apparatus by movement of the user's hips and buttocks in a natural rhythmic manner without the use of hands.

U.S. Pat. No. 6,540,667, issued Apr. 1, 2003 to Hickman, indicates a sexual assistance device and methods which may be used as a marital aid are disclosed which include two elongate members secured by a pivotal connection. A biasing element, such as a spring coil, is disposed at or adjacent the pivotal connection for biasing the opposite ends of the two elongate members away from each other. Respective supports are provided at the two opposite ends of the two elongate members which are engageable with the operator's legs. A sexually stimulating element, such as a vibrator or the like, is preferably removably attached to the pivotal connection. Thus, the operator may produce reciprocal longitudinal movement inwardly and outwardly, relative to the operator's body, by compressing and uncompressing the two elongate members with the legs of the operator thereby fully controlling movement of the sexually stimulating element by the legs of the operator. The biasing force is preferably relatively weak so as to permit easy closing of the operator's legs while still providing a suitable force to permit the legs to securely contact the ends of the two elongate members.

U.S. Pat. No. 6,849,041, issued Feb. 1, 2005 to Astin, is for a phallus retention harness for retaining a phallus with a base portion and an elongate body portion relative to a wearer with a pocket member for receiving and retaining the phallus wherein the pocket member has a first panel and a second panel with an inner volume between the front panel and the rear panel, an aperture in the front panel of the pocket member for enabling the elongate body portion of the phallus to extend therethrough, and an arrangement for retaining the pocket member relative to the wearer's body.

U.S. Pat. No. 4,989,592, issued Feb. 5, 1991 to Chang, puts forth a type of device to improve male sexual potency; a penis protecting pad made of flexible material; on the upper edge of the penis protecting pad are two adjusting pads, and on its lower edges are left and right adjusting belts respectively pulled through the slots on the waist band. On the lower part of the penis protecting pad is a threaded tube joint to accommodate an inside threaded tube body. One end of the tube body is jointed and adhered to a flexible glans penis to form a penis-shaped structure to be worn onto a real penis.

U.S. Pat. No. 6,547,717, issued Apr. 15, 2003 to Green et al, provides a multi-facet sexual aid device for increasing the level of sexual enjoyment between partners which includes a waist belt having a first, second and third belt portion. The first belt portion has a substantially planar portion and a first and second attachment end. The planar portion is a parabolic shaped front element which include a spring-loaded attachment mechanism within a substantially central portion of the planar portion for attaching at least one prosthetic phallic element thereto, as a quick release and quickly deployed element. A couple connector is also used to couple a plurality of different prosthetic phallic elements as either a convex or concave connection to the spring-loaded mechanism. The free ends of each second and third belt portions are fixedly secured at opposing internal first and second internal surface portions via hook and loop fasteners.

U.S. Pat. No. 5,103,810, issued Apr. 14, 1992 to Chang, claims a sexual aid which has a tubular body with a connection piece, two bands sewn or adhered to a lower end of the connection piece and a guard sewn to an upper end of the connection piece. For adjustment of the tightness of the device, a waistband adhered to the guard by adhesive tapes defines slots through which pass ends of the two bands. The tubular body has a number of peaks and valleys running along spiral lines which, with a ring element, stimulate the woman in order to make her reach orgasmic phase more quickly. The tubular body is a hollow structure with a hole at the front end to allow sperm to flow therethrough.

U.S. Patent Application #20090131744, published May 21, 2009 by Pattenden, illustrates a hip-worn sexual aid device comprising an inner region, and an outer region, wherein at least the outer region is fabricated of a molded, lofted foam material that is non-porous, wherein the outer region is configured for use with at least one of an orifice, genitalia and erogenous zone of at least one user.

U.S. Patent Application #20090229617, published Sep. 17, 2009 by Bowman, provides a primarily movement-based, biomechanically advanced interactive apparatus, that can be operated via simultaneous hand and feet action to encourage participation of all major joints/muscles of the body and which is designed to work with the body in motion. The interactive apparatus is designed as a carrier for a wide range of prosthesis of an adult nature and can provide user-controlled multi-plane movement patterns for the same.

What is needed is a foot-mounted sexual satisfaction device to permit hands-free sexual self-satisfaction and mutual satisfaction.

BRIEF SUMMARY OF THE INVENTION

An object of the present invention is to provide a foot-mounted sexual satisfaction device to permit hands-free sexual self-satisfaction and mutual satisfaction.

In brief, the present invention is a dildo harness attached to a foot-sleeve, therefore making the entire entity a foot-sleeve dildo harness. The foot-sleeve dildo harness allows the user to insert a dildo vaginally or anally in the wearer or in a sexual partner, therefore allowing for hands-free vaginal and/or anal stimulation.

The dildo sleeve harness allows for attachment of any strap-on compatible dildo to the bottom of the foot or to the back of the heel. The foot-worn dildo device comprising an elasticized (preferably neoprene) foot-worn sleeve and an attached dildo harness through openings in which the dildo may be held or upon which the base of the dildo may rest and a strap and O-ring assembly used for holding the dildo in place against the dildo harness. The strap and O-ring assembly comprises an O-ring for surrounding the shaft of the dildo and straps attached to the dildo harness at the bottom of the foot and the back of the heel together with straps that attach adjustably around the foot to hold the O-ring in place.

The advantages of the present invention include, without limitation, that it easily allows for hands-free vaginal and anal stimulation. The device can easily slide on the wearer's foot with a dildo extending from the heel and can be used by either sitting on the back of the wearer's heel (having the dildo enter the vagina or anus), or a wearer lying on the wearer's back and bending the wearer's knee may insert the dildo vaginally. The invention can also be used simultaneously by two women sitting across from each other and sliding the dildo to the bottom of the foot-sleeve dildo harness where they can insert the dildo into each other's vaginas, while using their toes for further clitoral stimulation.

In broad embodiment, the present invention is a foot-sleeve dildo harness that mounts a dildo onto the rear or bottom of the harness allowing the wearer to stimulate a vagina or anus on the wearer or on another person.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1A:
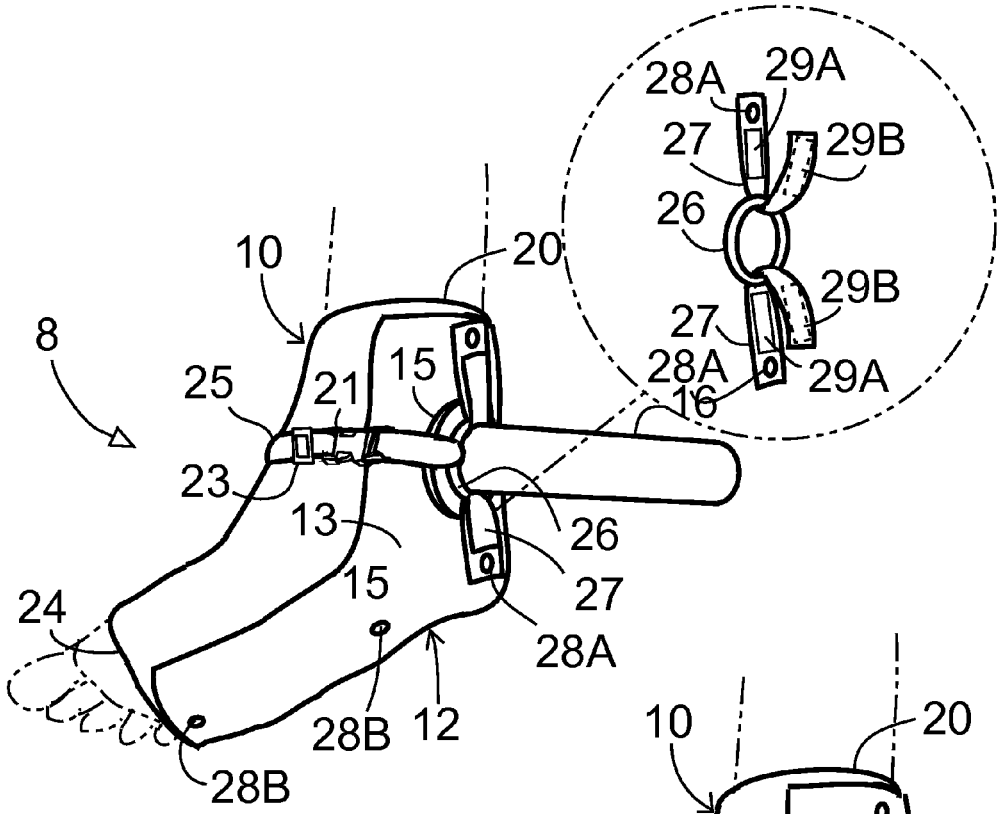
FIG. 1 is a perspective view of the preferred embodiment of the foot sleeve dildo harness of the present invention showing one dildo attached to the heel and another dildo attached to the bottom of the foot using strap and O-ring assemblies.
Figure 1B:
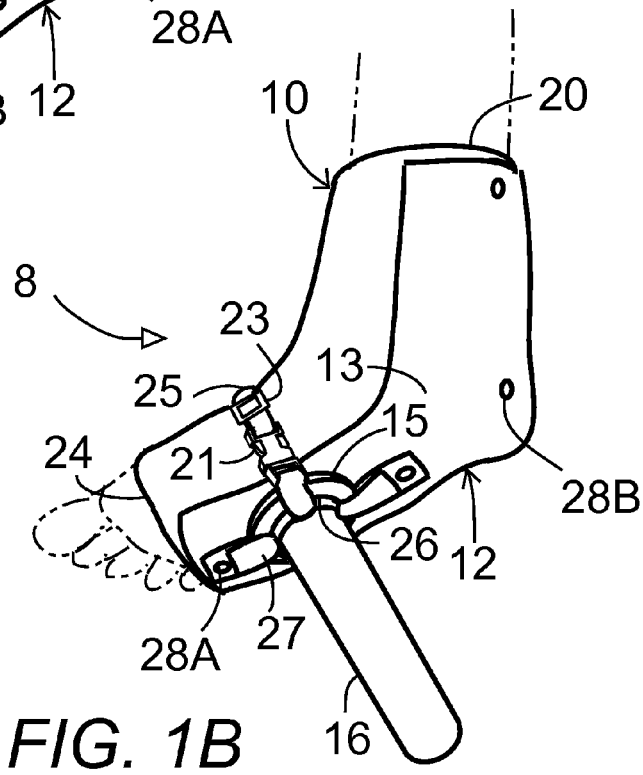
Figure 2A:
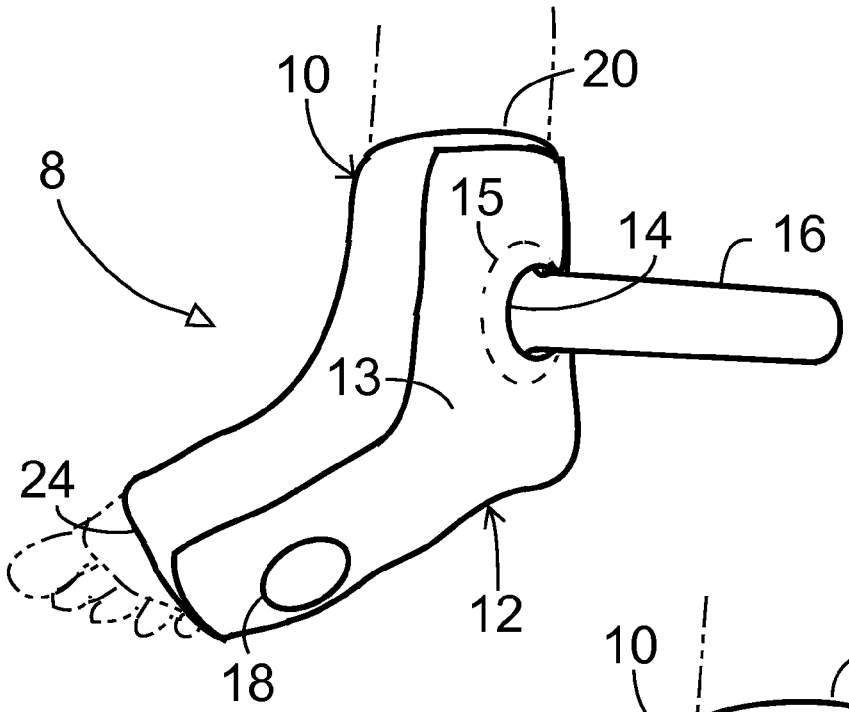
FIG. 2 is a perspective view of an alternate embodiment of the foot sleeve dildo harness of the present invention showing one dildo attached to the heel and another dildo attached to the bottom of the foot each through a separate opening in the dildo harness.
Figure 2B:
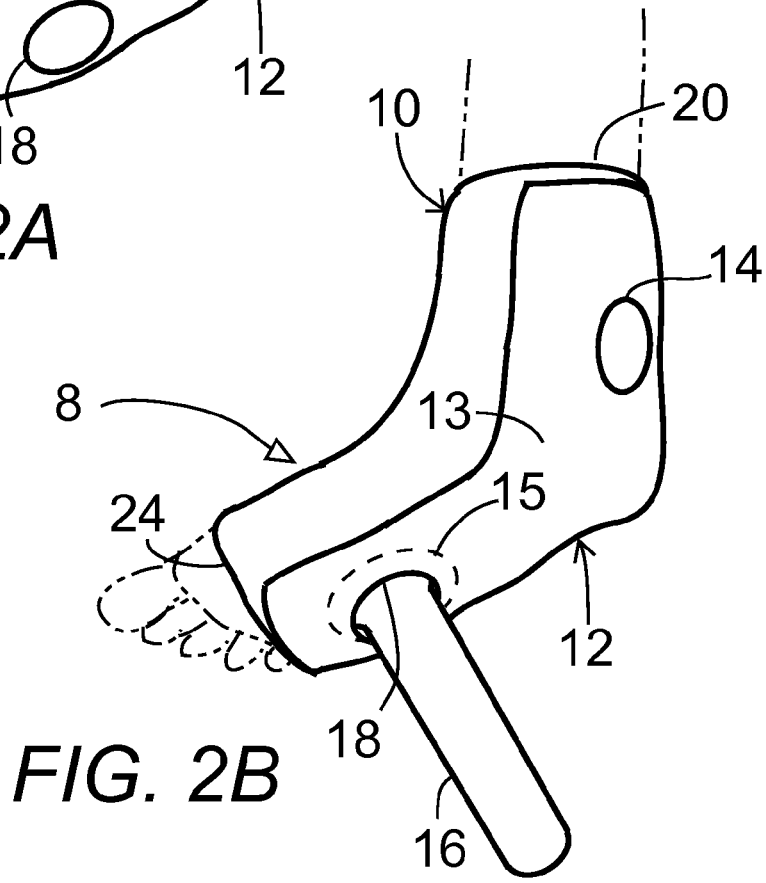

In FIGS. 1A, 1B, 2A, 2B and 3, a foot sleeve dildo harness device 8 comprising a foot sleeve 10 and attached dildo harness 12 having straps 25 and 27 and O-rings 26 forming assemblies for securing any type of body attachable dildo 16 to a heel or a bottom of the foot of a wearer, as shown in FIGS. 1A and 1B, or having openings 14 and 18 in the dildo harness for receiving a dildo 16 inserted therethrough, as shown in FIGS. 2A and 2B, for vaginal and anal stimulation of the wearer or a sexual partner.

The foot sleeve 10 is worn on a foot of a wearer encircling at least a front portion including a portion of the foot bottom and further encircling an ankle and a heel portion of the foot with a heel opening 22 and a toe opening 24 to allow ventilation and toe stimulation.

The dildo harness 12 comprises a dildo receiving strip 13, extending down the back of the heel and along the bottom of the foot, attached to the foot sleeve 10 by stitching, adhesive, mechanical fasteners, mating hook and loop fasteners or other attaching means and may extend in one strip of dildo receiving material 13 down the back of the foot, around the heel, and along the bottom of the foot or may be in two separate components, one on the heel and the other on the bottom of the foot. The dildo harness 12 further comprises strap 25 and 27 and O-ring 26 means for attaching any of a variety of dildos 16 to the device on a bottom of the foot so that any type of body attachable dildo 16 extends orthogonally downward from the bottom of the foot and on a heel of the foot so that the dildo 16 extends orthogonally rearward from the heel of the foot for vaginal or anal insertion in the body of the wearer or the body of a sex partner.

In FIGS. 1A and 1B, the means for attaching any of a variety of dildos 16 comprises as least one dildo harness 12 having a dildo receiving strip 13 for receiving a base 15 of each of the dildos 16 resting on the strip and an O-ring 26 for encircling the base 15 of each of the dildos 16 and at least one adjustable strap 25 extending from the O-ring 26 to encircle the foot of the wearer to secure the dildo 16 to the sleeve 10. The foot encircling strap 25 has a clamp 21 for securing the strap and an adjustable buckle 23 to adjust the length of the strap. The first strap 25 encircles the front of the foot to secure the dildo 16 on the bottom of the foot and encircles the ankle and heel of the foot to secure the dildo 16 at the back of the foot. It is preferred that a pair of harness strip attaching straps 27 attach each of the O-rings 16 to the harness strip 13 preferably by a snap 28A attached to a mating snap 28B on the harness strip 13 and an overlapping portion of the strap which encircles the O-ring and attaches to itself adjustably by mating hook and loop fasteners 29A and 29B attached to facing sides of the straps 27.

In FIGS. 2A and 2B, the dildo receiving strip 13 has one opening 14 and 18 for a dildo 16 therethrough to receive the dildo 16 inserted through the at least one opening. The bottom opening 18 receives the bottom dildo 16 inserted therethrough with the base 15 of the dildo retained between the dildo receiving strip 13 and the sleeve 10. The back heel opening 14 receives the back heel dildo 16 inserted therethrough with the base 15 of the dildo retained between the dildo receiving strip 13 and the sleeve 10.

Figure 3:
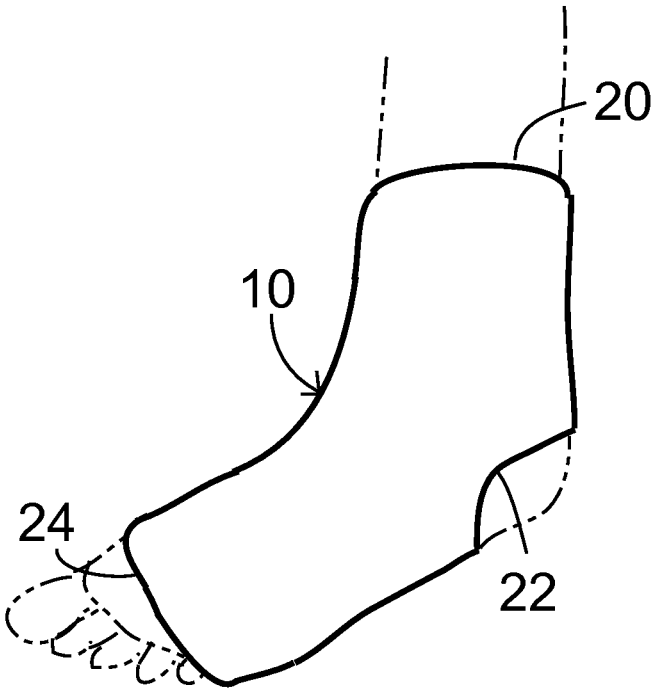
FIG. 3 is a perspective view of the foot sleeve of the present invention showing the toe and heel openings.

In FIG. 3, the sleeve 10 has a top opening 20 to receive the foot of the wearer inserted therein and a heel opening 22 for ventilation and a toe opening 24 for ventilation and to allow stimulation by the toes of the wearer.

The foot sleeve 10 can come in multiple sizes (small, medium and large) to fit multiple foot sizes and can range from 4 to 5 inches deep and 4 to 5 inches in height. The dildo harness 12 may be between 3 to 3.5 inches in diameter and 4.5 to 5.5 inches in length. In FIG. 2, the rear hole 14 may be 0.5 to 1 inch in diameter and the bottom hole 18 may be 0.5 to 1 inch in diameter. The O-rings of FIG. 1 may come in different sizes to accommodate different sizes of dildos.

The construction details of the invention are that the foot-sleeve 10 and dildo harness 12 may be made of a flexible yet supportive material such as neoprene, or any other sufficiently flexible and stretchy material. Further, the various components of foot-sleeve 10 can be made of different materials.

While it is likely that different manufacturers may produce the same type of dildos 16 with differing shapes and sizes, it is also likely that one particular manufacturer may produce a model of the same type of dildos 16 which is comprised of a similar design and dimensions that would fit through the dildo harness 12. This dildo 16 would then be used for vaginal and/or anal stimulation.

The hook and loop fastener straps 27 are removable and are adhered by a simple snap. The female end of the plastic buckle straps 25A and 25B are sewn onto the foot-sleeve permanently. The male end of the plastic buckle straps may have a metal snap that allows you to remove them for attaching to different sized O-rings for dildos with different girths.

The dildo receiving strip 13 may be just another piece of neoprene sewn to the foot sleeve 10 for extra durability and comfort. This is what the dildo's base actually rests on in FIGS. 1A and 1B.

In use, the wearer will slide their foot through top opening 20 of the foot-sleeve 10. Once the foot-sleeve 10 is on their foot, the user's heel is exposed through heel opening 22 and toes are exposed through toe opening 24, as seen in FIG. 3, for proper support and ventilation.

The present invention easily allows for hands-free vaginal and anal stimulation. The device can easily slide on the wearer's foot with a dildo extending from the heel and can be used by either sitting on the back of the wearer's heel (having the dildo enter the vagina or anus), or a wearer lying on the wearer's back and bending the wearer's knee may insert the dildo vaginally. The invention can also be used simultaneously by two women sitting across from each other and sliding the dildo to the bottom of the foot-sleeve dildo harness where they can insert the dildo into each other's vaginas, while using their toes for further clitoral stimulation.

In broad embodiment, the present invention is a foot-sleeve dildo harness that mounts a dildo onto the rear or bottom of the harness allowing the wearer to stimulate a vagina or anus of the wearer or of another person.

It is understood that the preceding description is given merely by way of illustration and not in limitation of the invention and that various modifications may be made thereto without departing from the spirit of the invention as claimed.

What is claimed is:

1. A foot-sleeve dildo harness comprising:

an elasticized foot-sleeve with an ankle region and foot region further comprising two openings corresponding to a side of a foot, each opening extending through said foot-sleeve;

a first of said two openings located at said ankle region;

a second of said two openings located at said foot region;

a plurality of straps, each separately extending from a periphery of at least said first or second opening;

a rigid O-ring held in place by each strap of said plurality of straps such that a space is formed between at least said first or second opening and said O-ring, said space comprising a continuous, uninterrupted, opening extending through said foot-sleeve and said O-ring; wherein said space is adapted to secure a base of a dildo between said O-ring and said foot-sleeve while said dildo extends through said O-ring.

2. The harness of claim 1, wherein said foot-sleeve comprises an obtuse angle on a top part thereof, between an ankle portion of said foot-sleeve and a foot portion of said foot-sleeve, and at least one of said openings is located on a bottom side of said foot portion of said foot-sleeve, and in use, is positioned on said foot-sleeve corresponding to a bottom of said foot of a wearer of said foot-sleeve.

3. The harness of claim 1, wherein said foot-sleeve comprises an obtuse angle on a top part thereof, between an ankle portion of said foot-sleeve and a foot portion of said foot-sleeve, and at least one of said openings is located on a back side of said ankle portion of said foot-sleeve, and in use, is positioned on said foot-sleeve corresponding to a heel of a wearer of said foot-sleeve.

4. The harness of claim 3, wherein said plurality of straps extend from locations on said back side of said foot-sleeve, from positions on said foot-sleeve corresponding to said heel of said wearer, in use.

5. The harness of claim 1, wherein said plurality of straps are removable from said foot-sleeve and are replacable, without destroying said foot-sleeve or said plurality of straps.

6. The harness of claim 5, wherein said plurality of straps further comprise a metal snap adapted to snap together with said O-ring between said strap and said metal snap.

7. The harness of claim 6, wherein at least one strap of said plurality of straps has a different size and different girth such that said at least one strap of said plurality of straps is long enough to go around a circumference of said foot-sleeve.

8. The harness of claim 1, further comprising a dildo attached in a manner as to be held firm to a solid object on which said foot-sleeve is worn.

9. The harness of claim 7, wherein, said at least one strap surrounds said foot-sleeve.

* * * * *